US006033581A

United States Patent [19]

Kobayashi

[11] Patent Number: 6,033,581

[45] **Date of Patent: *Mar. 7, 2000**

[54] PROCESS FOR PRODUCING INK JET RECORDING HEAD

[75] Inventor: Junichi Kobayashi, Ayase, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/862,465

[22] Filed: May 23, 1997

[30] Foreign Application Priority Data

May 28, 1996 [JP] Japan ..... 8-133579

[51] Int. Cl.[7] ..... B44C 1/22

[52] U.S. Cl. ..... 216/27; 216/2; 216/33; 216/56

[58] Field of Search ..... 216/2, 27, 33, 216/38, 56; 438/733

[56] References Cited

U.S. PATENT DOCUMENTS 4,786,357 11/1988 Campanelli et al. ..... 216/27
5,436,650 7/1995 Kobayashi et al. ..... 347/63
5,479,197 12/1995 Fujikawa et al. ..... 347/63
5,491,505 2/1996 Suzuki et al. ..... 347/203
5,580,468 12/1996 Fujikawa et al. ..... 216/27

*Primary Examiner*—William Powell
*Attorney, Agent, or Firm*—Fitzpatrick, Cella, Harper & Scinto

[57] ABSTRACT

A process for producing an ink jet recording head comprising a silicon substrate having an ink discharge pressure generating element for discharging ink, a discharge opening from which an ink is discharged, provided above the silicon substrate, an ink flow path communicating with the discharge opening, an ink feed opening through which the ink is fed to the ink flow path, and a support for supporting the silicon substrate, and being able to discharge a plurality of different inks, the process comprises the steps of subjecting the silicon substrate to anisotropic etching to form the ink feed opening for each ink and to simultaneously form a groove around the ink feed opening of the silicon substrate, and bonding the silicon substrate to the support in such a state that a protrusion provided on the support at its part corresponding to the groove of the silicon substrate is fitted to the groove.

7 Claims, 5 Drawing Sheets

PROCESS FOR PRODUCING INK JET RECORDING HEAD

BACKGROUND OF THE INVENTION

1. Field of the Invention

This invention relates to a process for producing an ink jet recording head that generates recording liquid droplets, used in ink jet recording systems.

2. Related Background Art

Ink jet recording heads used in ink jet recording systems (liquid jet recording systems) commonly comprise fine recording liquid discharge openings (orifices), liquid flow paths, a plurality of liquid discharge energy generators (hereinafter also "ink discharge pressure generating elements") provided at part of the liquid flow paths, and ink feed openings through which ink is fed. In the case of ink jet recording heads mounted to color printers, ink jet recording heads corresponding to respective colors are mounted in number identical to necessary colors so that they correspond in a one-color one-head fashion.

With such constitution, however, it is difficult to make recording apparatus compact, and the ink jet recording heads require a high production cost, resulting in a high production cost for the recording apparatus. As a countermeasure for such problems, an ink jet recording head is proposed which can discharge inks corresponding to a plurality of colors in one head. The head of this type is constituted of ink discharge openings, ink flow paths and ink feed openings which are independently assigned to the respective colors and provided in one head (one support or substrate), where the sections for respective colors inside the head are, e.g., sealed with a sealing medium so that the colors of adjoining inks having different colors can be prevented from mixing.

The ink jet recording head is comprised of a substrate (internally provided with ink feed openings) and some support bonded to the substrate for the purposes of, e.g., communication with an external ink feed system and hold of the substrate. Here, when a flat-platelike substrate and the support are bonded with an adhesive, it has been necessary to strictly control the manner of coating the adhesive, the viscosity of the adhesive and so forth so that the adhesive does not flow into the ink feed openings to cause faulty ink feeding. Also, the support must be bonded to the substrate under accurate registration (positional adjustment) so as not to cause inhibition of ink feeding.

This has not been so much questioned when the head is constituted of a one-color head, but is estimated to be controllable with difficulty when one head is constituted so as to enable discharge of multiple color inks or when the head is made compact to become minute and finer.

SUMMARY OF THE INVENTION

The present invention was made taking account of the circumstances as stated above. Accordingly, an object of the present invention is to provide a production process that can prevent the adhesive from flowing into the intended ink feed openings, also can surely prevent color mixing of adjoining inks having different colors and still also enables easy registration between the substrate and the support, without addition of any special steps.

To achieve the above object, the present invention provides a process for producing an ink jet recording head comprising a silicon substrate having an ink discharge pressure generating element for discharging ink, a discharge opening from which an ink is discharged, provided above the silicon substrate, an ink flow path communicating with the discharge opening, an ink feed opening through which the ink is fed to the ink flow path, and a support for supporting the silicon substrate; and being able to discharge a plurality of different inks;

the process comprising the steps of:

subjecting the silicon substrate to anisotropic etching to form the ink feed opening for each ink and to simultaneously form a groove around the ink feed opening of the silicon substrate; and bonding the silicon substrate to the support in such a state that a protrusion provided on the support at its part corresponding to the groove of the silicon substrate is fitted to the groove.

The present invention constituted as described above makes it possible to prevent the adhesive from flowing into the ink feed openings and also to prevent color mixing of adjoining inks having different colors. It also enables easy registration between the substrate and the support.

DESCRIPTION OF THE PREFERRED EMBODIMENTS

The present invention will be described below in detail by giving an example according to the present invention.

Figure 1:
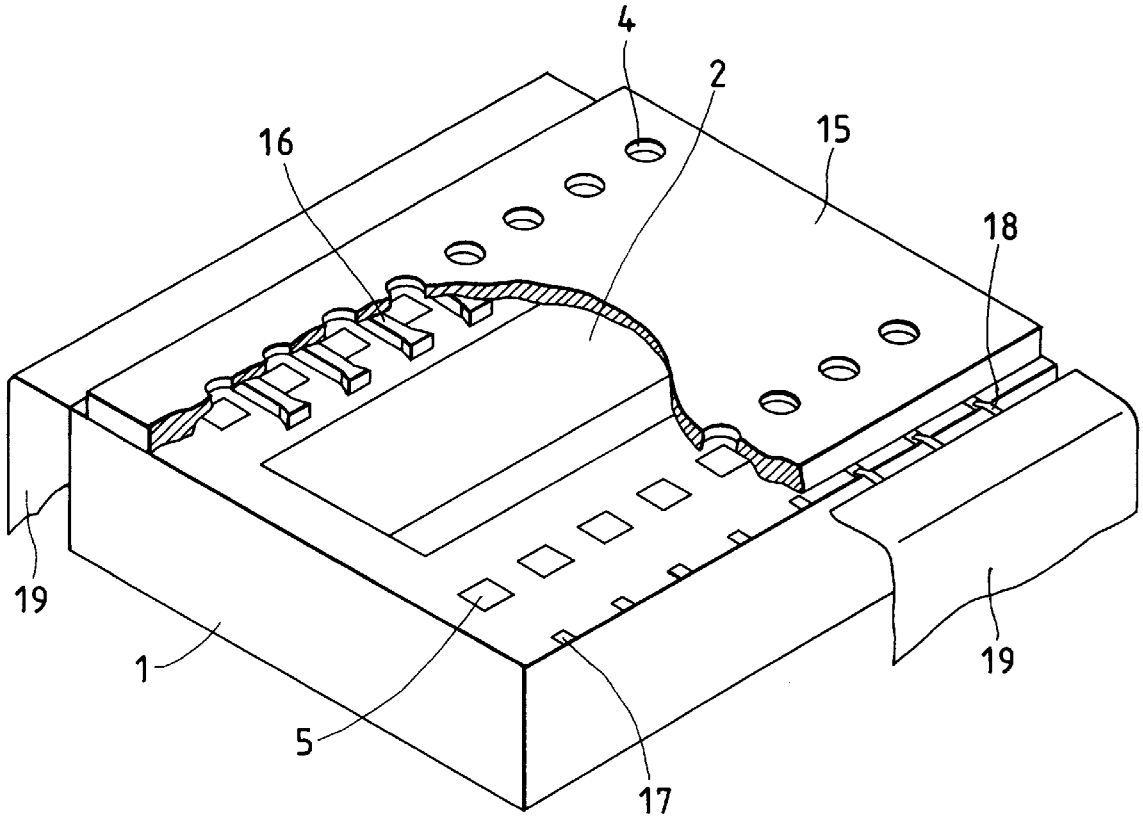
FIG. 1 is a diagrammatic perspective view of an example of a commonly available ink jet recording head.

FIG. 1 is a diagrammatic perspective view showing the constitution of a commonly available ink jet recording head.

As shown in FIG. 1, a silicon substrate 1 is provided thereon with ink discharge pressure generating elements 5 (heaters, thermoelectric transducers, piezoelectric devices, etc.). Corresponding to the ink discharge pressure generating elements 5, ink flow paths and ink discharge openings 4 are formed in desired number. In addition, a common liquid chamber for feeding ink to each ink flow path and ink feed openings 2 are formed. Reference numeral 15 denotes an orifice plate; 16, ink flow path walls; 17, electrode pads; 18, beam leads; and 19, TAB tapes.

Since, however, the components described above are not important in the present invention and can be formed by conventional known processes, detailed description on these is omitted.

Figure 2:
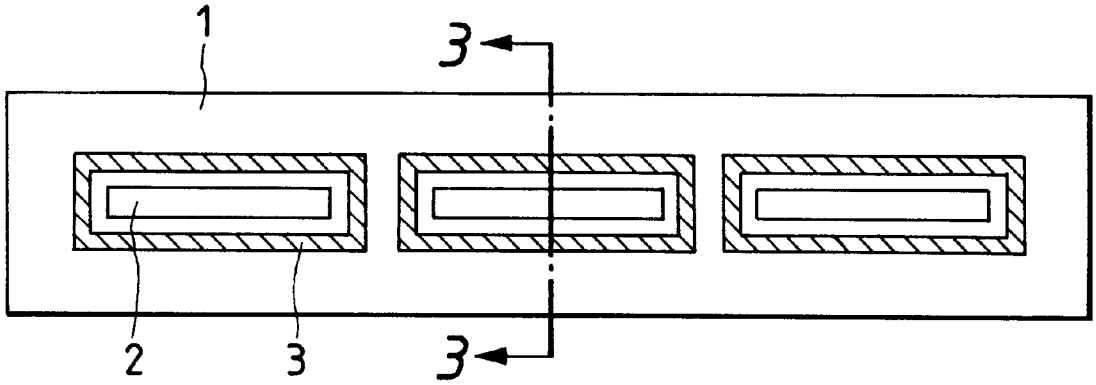
FIG. 2 is a diagrammatic view of the back of the substrate.
Figure 3:
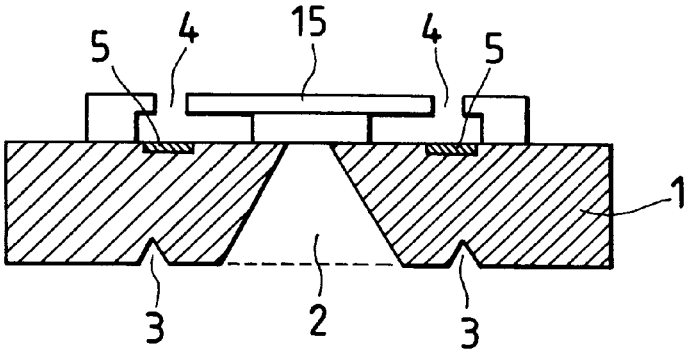
FIG. 3 is a diagrammatic cross-sectional view showing a cross section along the line 3—3 in FIG. 2.
Figure 4:
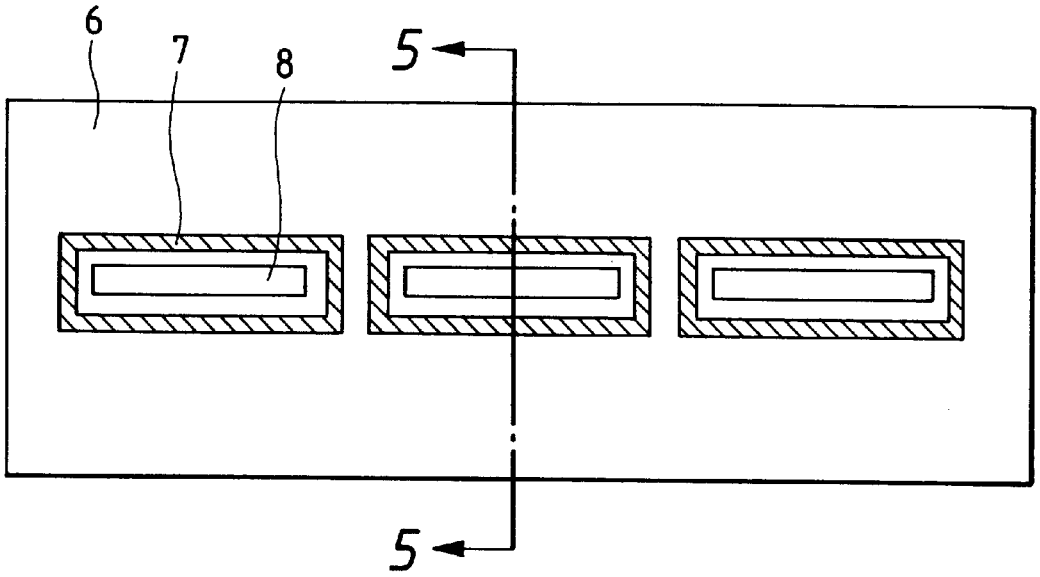
FIG. 4 is a diagrammatic plan view of the support.
Figure 5:
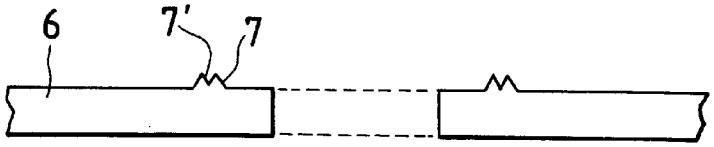
FIG. 5 is a cross-sectional view along the line 5—5 in FIG. 4.
Figure 6:
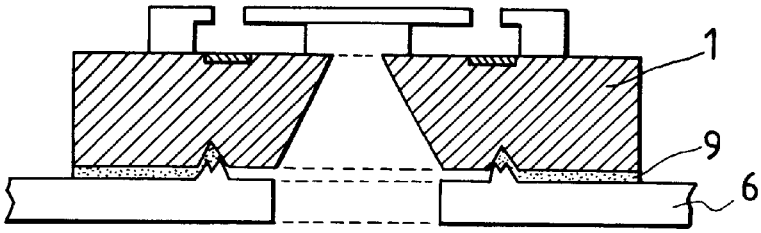
FIG. 6 is a cross-sectional view of the FIG. 3 substrate and the FIG. 5 support which are put together by bonding.
Figure 7:
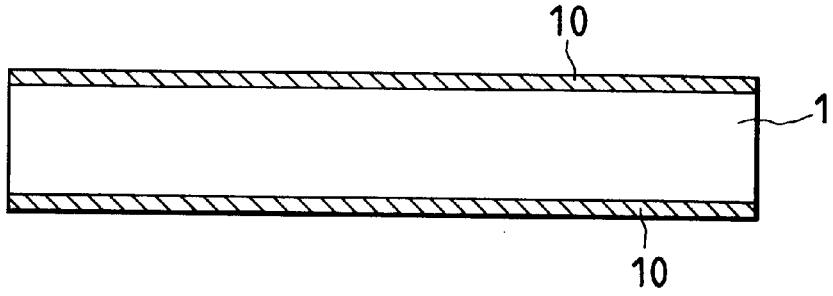
FIG. 7 is a cross-sectional view of a substrate on which a film has been formed by thermal oxidation.
Figure 8:
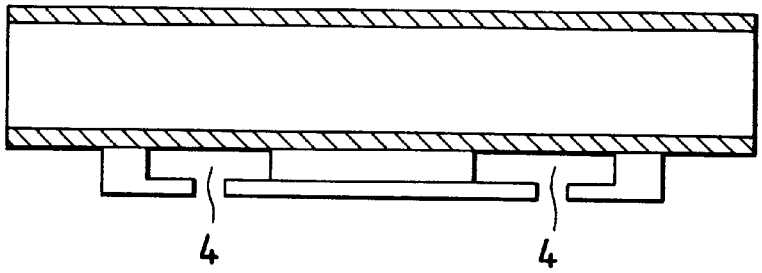
FIG. 8 is a diagrammatic cross-sectional view showing a mechanical system of the ink jet recording head.
Figure 9:
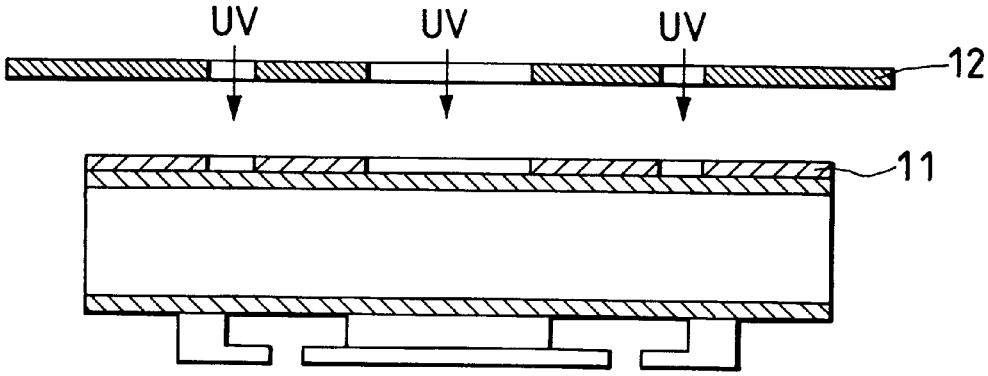
FIG. 9 is a cross-sectional view of exposed areas of a photoresist.
Figure 10:
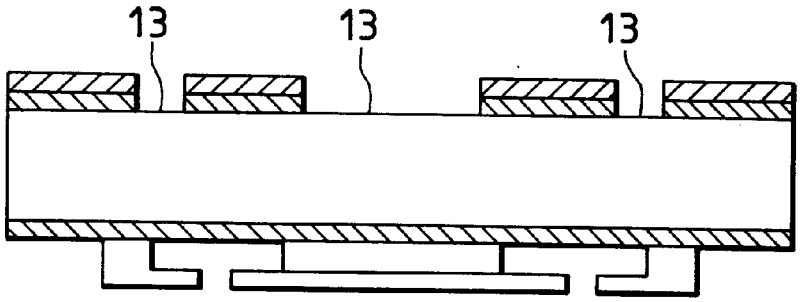
FIG. 10 is a diagrammatic cross-sectional view of pattern formation of the film formed by thermal oxidation.
Figure 11:
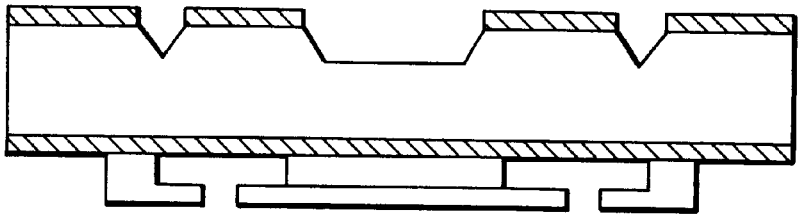
FIG. 11 is a diagrammatic cross-sectional view showing how anisotropic ethcing progresses.
Figure 12:
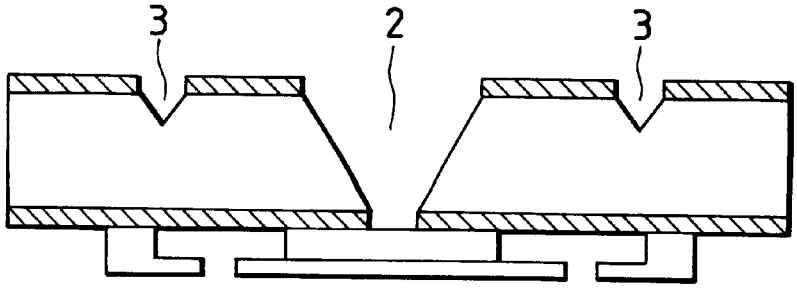
FIG. 12 is a diagrammatic cross-sectional view showing how anisotropic ethcing has been completed.

Incidentally, FIG. 2 is a diagrammatic view of the back of the silicon substrate 1; FIG. 3, a diagrammatic cross-sectional view along the line 3—3 in FIG. 2; FIG. 4, a diagrammatic plan view of a support 6; FIG. 5, a cross-sectional view along the line 5—5 in FIG. 4; FIG. 6, a cross-sectional view of the FIG. 3 substrate and the FIG. 5 support which are put together by bonding; FIG. 7, a cross-sectional view of a substrate on which a film has been formed by thermal oxidation (hereinafter "thermal oxidized film"); FIG. 8, a diagrammatic cross-sectional view showing a mechanical system of the ink jet recording head; FIG. 9, a cross-sectional view of exposed areas of a photoresist; FIG. 10, a diagrammatic cross-sectional view of pattern formation of the thermal oxidized film; FIG. 11, a diagrammatic cross-sectional view showing how anisotropic ethcing progresses; FIG. 12, a diagrammatic cross-sectional view showing how anisotropic ethcing has been completed.

The present invention is chiefly characterized in that a silicon wafer having crystal orientation of (100) plane of single-crystal silicon is used as the substrate 1 and is processed by anisotropic etching utilizing the crystal direction. In the present example, these points will be described in detail.

FIG. 2 illustrates the silicon substrate 1 on which the ink discharge pressure generating elements 5, the ink flow paths and the discharge openings 4 have been formed, as viewed from the back of the substrate, in which reference numeral 2 denotes a ink feed opening, and 3, a groove formed around the ink feed opening. FIG. 3 is a diagrammatic cross-sectional view along the line 3—3 in FIG. 2. In the present example, an ink jet recording head that can discharge inks having three different colors is formed on the same substrate. The foregoing is an example. In the process of the present invention, of course a head comprising a plurality of substrates provided for each color in the area of the same support may also be used without any difficulty.

In the present example, a silicon wafer having (100) plane is used as the substrate 1. At least on the back thereof, a thermal oxidized film 10 ($SiO_2$) is previously formed as cross-sectionally shown in FIG. 7. In usual instances where the ink discharge pressure generating element 5 is formed, as the first step, an insulating layer such as the thermal oxidized film 10 is formed on the silicon substrate 1 as a layer insulating the silicon substrate 1. In the present example, such a step is utilized to form the thermal oxidized film 10, by means of which the thermal oxidized film 10 can be simultaneously formed on the both sides of the silicon substrate 1. In the case of the present example, the thermal oxidized film 10 formed on the back (i.e., the side on which no ink discharge pressure generating element is formed) is utilized as an anti-etching mask of the anisotropic etching described later. If the simplification of steps need not be taken into account, the anti-etching mask on the back may of course be separately formed without any difficulty.

In the present example, the thermal oxidized film 10 is formed in a thickness of from 5,000 angstroms to 8,000 angstroms. This thickness of the oxidized film is based on a finding obtained in the present example from the viewpoints of film defect density and film stress, and may preferably be appropriately controlled depending on the size and thickness of the silicon substrate 1.

Next, the thermal oxidized film 10 on the back is processed by photolithography to pattern the thermal oxidized film 10 as shown in FIG. 9, by the use of a photomask 12 designed to have a pattern corresponding to ink feed openings 2, and grooves 3 intended to prevent the adhesive from flowing and make simple registration to the support 6. This pattern is formed in conformity with the constitution shown in FIG. 8, previously provided with the ink discharge system such as ink flow paths and ink discharge openings.

The pattern is formed by the procedure as shown below.

Step 1:

On the thermal oxidized film 10 formed on the back of the silicon substrate 1, a photoresist 11 (trade name: OFPR-800; available from Tokyo Ohka Kogyo Co., Ltd.) is coated in a thickness of about 1.5 $\mu$m by spin coating, followed by drying (pre-baking).

Step 2:

As shown in FIG. 9, the photoresist is exposed to ultraviolet light using as a mask the photomask 12 provided with the desired pattern described above. When it is exposed, in the present example, the pattern according to which the functional elements such as the ink discharge pressure generating elements 5 formed on the surface side of the silicon substrate 1 are provided must be precisely registered to the pattern of the ink feed openings and the grooves which is to be processed on the back of the silicon substrate, and hence a commonly available apparatus called a double-side masked exposure apparatus or back-side masked exposure apparatus is used as an apparatus that can recognize registration marks formed on the surface side of the silicon substrate 1, to make registration to the pattern on the back.

A method of designing the photomask pattern of the portions that form the grooves 3 will be described below.

As well known in the art, when the (100) plane silicon wafer 1 is subjected to anisotropic etching, the relationship between etching depth and opening width of opening portion 13 (FIG. 10) on the surface where the etching is started is represented by the following expression.

$$\text{Opening width } (W) = \sqrt{2} \times \text{etching depth } (t)$$

Hence, it is possible to design the desired groove depth and opening width according to the above theoretical expression.

In the present example, the etching depth is designed so as to be about 140 $\mu$m, and hence, as mask designing, the photomask may be designed to have an opening width of 200 $\mu$m. In actual anisotropic etching, however, with the progress of etching in the depth direction, etching simultaneously takes place in the lateral direction (commonly called "side etching"). Hence, when the size is more precisely controlled, the amount of side etching may be previously found by an experimental route and the size corresponding to the amount of side etching may be corrected when the mask is designed. Thus, the size can be precisely controlled.

Step 3:

The thermal oxidized film 10 is etched using an RIE (reactive ion etching) apparatus. As etching methods, in addition to the method using the RIE apparatus, there are various means for etching the thermal oxidized film 10. In the case of the present example, any means may be used.

Step 4:

After the thermal oxidized film 10 has been etched, the photoresist 11 is removed simultaneously at the time of anisotropic etching. In the case of the positive photoresist 11 as used in the present example, alkali type chemicals are used like almost all cases when photoresists are stripped using chemicals.

In the present example, an alkali type etchant is used as an anisotropic etchant in the step of anisotropic etching. Hence, the above photoresist need not be stripped in advance, and can be stripped simultaneously at the time of anisotropic etching. Accordingly, an independent step of removing the photoresist is omitted.

The pattern formation of the thermal oxidized film 10 is completed in the previous step, and the pattern of the thermal oxidized film 10 functions as an anti-etching mask against the etchant used in the anisotropic etching (see FIG. 10). The anisotropic etching in the present example is carried out using as the etchant a solution of 22% by weight of TMA (tetramethylammonium hydroxide), which is heated to 80° C. In the etching bath thus prepared, the silicon substrate 1 on which the thermal oxidized film 10 has been patterned is immersed to carry out etching. Thus, the ink feed opening 2 and the groove 3 are formed as shown in FIG. 12 via the state shown in FIG. 11.

The concentration of TMAH and etching temperature in the present example are conditions employed in relation to the etching rate of the silicon substrate 1 and the smoothness of the etching surface, and are by no means limited only to these. Conditions other than those in the present example may be selected depending on purpose. With regard to the etchant too, etchants such as KOH (potassium hydroxide) solution and NaOH (sodium hydroxide) solution may be used. In the case of such etchants, however, the thermal oxidized film 10 is not suited for its use as the anti-etching mask, and hence it should be replaced with a film of SiN (silicon nitride) or the like.

On the surface side of the silicon substrate 1, a jig designed so as not to expose the surface to the etchant may also be used so that the ink discharge pressure generating elements formed on the surface side of the silicon substrate 1 can be protected from the etchant. This makes it possible to surely protect the functional components formed on the surface side of the silicon substrate 1, bringing about an improvement in reliability. Thus, the use of such a jig is effective.

The support 6 shown in FIGS. 4 and 5 will be described below. The support 6 in the present example is made of aluminum, and ink feeding holes 8 and protrusions 7 surrounding them, which respectively face the ink feed openings 2 and the grooves 3 formed in the silicon substrate 1, are formed by mechanical. processing.

Next, as shown in FIG. 6, an adhesive 9 is coated on the outskirts of the protrusions 7, and thereafter the silicon substrate 1 on which the anisotropic etching has been completed is put together and bonded.

As shown in FIG. 5, a cross section along the line 5—5 of FIG. 4, a V-shaped groove may be further formed at the top of each protrusion 7, and the adhesive may be coated also on the V-shaped groove. This makes the adhesion perfect at the part where it is fitted to the groove of the silicon substrate 1, bringing about an improvement in adhesion and an improvement in sealing effect.

Here, aluminum is used as a material for the support 6 of the present invention. The material is by no means particularly limited to it.

(Other examples)

As one object of the present invention, the present invention is an effective means also when it is intended only to make registration between the substrate 1 and the support 6 in a good precision and with ease.

Any desired groove(s) 3 or concave(s) may be formed at any desired position(s) on the back of the substrate 1 by anisotropic etching according to the process and steps previously described. Separately, on the support 6, the protrusion(s) 7 that can fit to the position(s) corresponding to the groove(s) 3 or concave(s) formed on the back of the substrate 1 is/are previously formed, thus the registration can be made by only fitting the substrate 1 to the support 6.

As described above, the process of the present invention can bring about the following advantages:

1) When the support is bonded to the substrate, the adhesive can be prevented from flowing into the ink feed openings formed in the substrate and support and easy resistration between the substrate and the support is brought about.
2) When multi-color ink jet recording heads are mounted in the area of the same substrate, the color mixing that may occur at the adjoining ink feed openings can be surely prevented.

Of course, also when a single-color head is provided in the area of the same substrate, the process according to the present invention is effective in view of the prevention of ink from leaking from the ink feed opening and the easiness of registration to the support.

3) A highly reliable ink jet recording head can be provided without addition of any special step and at a low production cost.

What is claimed is:

1. A process for producing an ink jet recording head comprising a silicon substrate having an ink discharge pressure generating element for discharging ink, a discharge opening from which an ink is discharged, provided above the silicon substrate, an ink flow path communicating with the discharge opening, an ink feed opening through which the ink is fed to the ink flow path, and a support for supporting the silicon substrate; and being able to discharge a plurality of different inks;

the process comprising the steps of:

subjecting the silicon substrate to anisotropic etching to form the ink feed opening for each ink and to simultaneously form a groove around the ink feed opening of the silicon substrate; and bonding the silicon substrate to the support in such a state that a protrusion provided on the support at its part corresponding to the groove of the silicon substrate is fitted to the groove.

2. The process for producing an ink jet recording head according to claim 1, wherein the silicon substrate has a crystal orientation of (100) plane.

3. The process for producing an ink jet recording head according to claim 1, wherein the support is formed of aluminum.

4. The process for producing an ink jet recording head according to claim 1, wherein the silicon substrate is divided in plurality for each ink.

5. The process for producing an ink jet recording head according to claim 1, wherein a groove is further provided at the top of the protrusion of the support.

6. A process for producing an ink jet recording head comprising a silicon substrate having an ink discharge pressure generating element for discharging ink, a discharge opening from which an ink is discharged, provided above the silicon substrate, an ink flow path communicating with the discharge opening, an ink feed opening through which the ink is fed to the ink flow path, and a support for supporting the silicon substrate;

the process comprising the steps of:

subjecting the silicon substrate to anisotropic etching to form the ink feed opening for each ink and to simultaneously form a groove around the ink feed opening of the silicon substrate; and bonding the silicon substrate to the support in such a state that a protrusion provided on the support at its part corresponding to the groove of the silicon substrate is fitted to the groove.

7. A process for producing an ink jet recording head comprising a plurality of silicon substrates each having an ink discharge pressure generating element for discharging ink, a discharge opening from which an ink is discharged, provided above the respective silicon substrate, an ink flow path communicating with the discharge opening, an ink feed opening through which the ink is fed to the ink flow path, and a support for supporting the silicon substrates, and each of the silicon substrates is able to discharge a plurality of different inks;

the process comprising the steps of:

subjecting the silicon substrates to anisotropic etching to form the ink feed openings for each ink and to simultaneously form grooves around the ink feed openings of the silicon substrates; and bonding the silicon substrates to the support in such a state that a protrusion provided on the support at its part corresponding to the groove of each silicon substrate is fitted to the groove.

* * * * *

UNITED STATES PATENT AND TRADEMARK OFFICE

CERTIFICATE OF CORRECTION

PATENT NO. : 6,033,581

DATED : March 7, 2000

INVENTOR(S) : JUNICHI KOBAYASHI

It is certified that error appears in the above-identified patent and that said Letters Patent is hereby corrected as shown below:

COLUMN 1

Line 58, "also can surely" should read --and can also reliably--.

COLUMN 2

Line 43, "ethcing" should read --etching--; and
Line 45, "ethcing" should read --etching--.

COLUMN 3

Line 15, "ethcing" should read --etching--;
Line 17, "ethcing" should read --etching--; and
Line 28, "a ink" should read --an ink--.

COLUMN 4

Line 22, "is" should read --are--; and
Line 63, "like" should read --in--.

UNITED STATES PATENT AND TRADEMARK OFFICE

CERTIFICATE OF CORRECTION

PATENT NO. : 6,033,581

DATED : March 7, 2000

INVENTOR(S) : JUNICHI KOBAYASHI

It is certified that error appears in the above-identified patent and that said Letters Patent is hereby corrected as shown below:

COLUMN 5

Line 10, "TMA" should read --TMAH--; and
Line 42, "mechanical." should read --mechanical--.

COLUMN 6

Line 50, "plurality" should read --parts--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*